US005813898A

United States Patent [19]

Van Dan Elzen et al.

[11] Patent Number: 5,813,898

[45] Date of Patent: Sep. 29, 1998

[54] YO-YO HAVING ENGAGEMENT PADS PROXIMATE ITS AXLE

[75] Inventors: Hans W. Van Dan Elzen, Tempe; Thomas J. Van Dan Elzen, Oro Valley, both of Ariz.

[73] Assignee: Playmaxx, Inc., Tucson, Ariz.

[21] Appl. No.: 929,588

[22] Filed: Sep. 15, 1997

Related U.S. Application Data

[63] Continuation-in-part of Ser. No. 855,711, May 8, 1997.

[51] Int. Cl.[6] ..... A63H 01/30

[52] U.S. Cl. ..... 446/250

[58] Field of Search ..... 446/248, 249, 446/250, 251, 252, 253, 245

[56] References Cited

U.S. PATENT DOCUMENTS

| | | | |
|---|---|---|---|
| D. 366,289 | 1/1996 | Newcomer . | |
| 3,175,326 | 3/1965 | Isaacson . | |
| 3,201,895 | 8/1965 | Stivers . | |
| 3,256,635 | 6/1966 | Radovan | 446/251 |
| 3,717,949 | 2/1973 | Radovan . | |
| 3,805,443 | 4/1974 | Duncan, Jr. . | |
| 3,953,936 | 5/1976 | Ennis . | |
| 4,130,962 | 12/1978 | Ennis | 446/250 |
| 4,207,701 | 6/1980 | Kuhn | 446/250 |
| 4,332,102 | 6/1982 | Caffrey | 446/250 |
| 4,895,547 | 1/1990 | Amaral . | |
| 5,017,172 | 5/1991 | Seifert | 446/250 |
| 5,100,361 | 3/1992 | Kuhn et al. . | |

FOREIGN PATENT DOCUMENTS

| | | |
|---|---|---|
| 2132100 | 7/1984 | United Kingdom . |

*Primary Examiner*—Robert A. Hafer
*Assistant Examiner*—Jeffrey D. Carlson
*Attorney, Agent, or Firm*—Franklin L. Gubernick

[57] ABSTRACT

A yo-yo having unique tether engagement areas adjacent the axle. The engagement areas include an array of grooves and/or rubber pads located in the tether-facing surface of each of the yo-yo's side pieces. The grooves and/or pads extend from a point proximate the axle to a point significantly spaced from the axle. In the preferred embodiment, the grooves and/or pads are employed in conjunction with an axle having a ball bearing-supported rotatable outer race to which an end loop of the tether is secured.

25 Claims, 4 Drawing Sheets

YO-YO HAVING ENGAGEMENT PADS PROXIMATE ITS AXLE

This application is a Continuation-In-Part of application Ser. No. 08/855,711 filed May 8, 1997 and still pending.

FIELD OF THE INVENTION

The invention is in the field of user-manipulated toys. More particularly, the invention is an apparatus in the form of a yo-yo that functions in an improved manner relative to the prior art. This is achieved through the use of a specially-designed tether engagement area proximate the yo-yo's axle.

The tether engagement area makes use of an array of elongated grooves and/or high-friction engagement pads located on the tether-facing surface of each of the yo-yo's side members. The grooves and/or engagement pads function to facilitate engagement between the tether and the yo-yo's side members.

BACKGROUND OF THE INVENTION

Most yo-yos are in the form of two disk-shaped side members that are rigidly connected to each other by a wooden or metal axle. One end of a string-type tether is secured to the yo-yo's axle. A second end of the tether includes a loop that is placed about one of the user's fingers to thereby secure the yo-yo to the user. When the tether is wound about the axle and the yo-yo is released from the user's hand, the yo-yo will begin to rapidly spin as the tether unwinds from the axle. Once the tether is fully unwound, the yo-yo may "sleep" at the end of the tether, whereby the yo-yo continues to spin without having the tether rewind on the axle.

Once the yo-yo is sleeping, there are a number of yo-yo tricks one can perform with the spinning yo-yo. In some of these tricks, the spinning yo-yo is temporarily placed upon a portion of the tether intermediate of the tether's two ends. At the end of most yo-yo tricks, the user will jerk his or her hand or in some other fashion cause the tether to go momentarily slack. This causes the tether to engage/snag the axle and/or the tether-facing surface of at least one of the yo-yo's side members. Once engagement has occurred, the end portion of the tether will move with the side member(s) and thereby wind about the axle. The winding of the tether on the axle causes the yo-yo to return to the user's hand.

There are three crucial performance characteristics of a yo-yo that enable a user to perform most of the well-known yo-yo tricks. The yo-yo must be capable of sleeping for an extended period of time, it must not be subject to inadvertent snagging on the tether, and it should return on command.

Concerning a yo-yo's sleep time, the longer the yo-yo can be made to sleep, the more time the user will have to complete any particular yo-yo trick. It is well known that by minimizing friction in the yo-yo, one can maximize the yo-yo's sleep time.

Concerning the ability of a yo-yo to not snag the tether, when a snag occurs, the yo-yo will automatically rewind on the tether. When this happens inadvertently, the trick being performed will often be ruined. Two major factors that influence whether a yo-yo will tend to accidentally snag on the tether are the size of the yo-yo's string gap (the area between the two side members in which the string/tether is located) and the configuration of the tether-facing surface of each side member. For tricks in which the yo-yo is placed on an intermediate portion of the tether, the string gap must be sufficiently wide to receive a second portion of the tether either atop or more preferably beside the permanently-secured portion of the tether. Once the additional tether portion is within the gap, there must still be sufficient clearance so that both tether portions do not inadvertently snag on either of the side members. However, too wide a string gap may preclude a user's ability to have the yo-yo return on command, since the wide gap may make it impossible for the tether to engage either side member.

Concerning the ability of a yo-yo to return on command, the structure and design of the yo-yo must be such that when the tether is slackened momentarily by the user, the tether can move slightly to thereby engage the axle and/or side members. Once engagement occurs, the tether should then wind tightly on the axle so that upon the yo-yo's next release from the user's hand, the unwinding of the tether will cause the maximum rotational speed of the yo-yo. The ease with which the tether engages/snags the spinning portions of the yo-yo is often facilitated through the use of particular adaptations in the tether-facing surface of each of the yo-yo's side members.

In the prior art, there have been a number of inventions designed to enhance one or more of the above-listed yo-yo characteristics. For example, both Kuhn et al (U.S. Pat. No. 5,100,361) and Isaacson (U.S. Pat. No. 3,175,326) teach low-friction yo-yos in which the axle includes ball bearings to enable an outer portion of the axle to remain stationary while an interior portion of the axle rotates with the yo-yo's side members. Because the end of the tether is secured to the outer portion of the axle, friction between the tether and the axle is virtually eliminated. This configuration also alleviates the problem in the prior art of rapid tether failure due to frictional heating and wearing of the portion of the tether that contacts a spinning portion of the axle. However, since the tether can only engage a side member to cause the yo-yo to return to the user, this makes it harder for the user to have the yo-yo return on command.

The yo-yo taught in the above-noted Kuhn patent includes structure that enables a user to adjust the width of the yo-yo's string gap. However, in the Kuhn yo-yo, as well as in all other prior art yo-yos, a compromise must be made between a wide string gap that would reduce the chance of inadvertent snagging of the tether and a narrow string gap that would increase the chance of said engagement when the user desires the yo-yo to rewind on the string. As a result, proper adjustment of the Kuhn yo-yo is difficult to achieve and maintain. In every prior art yo-yo, this compromise limits the performance of the yo-yo.

To make it easier for a user to have the yo-yo return on command, Amaral (U.S. Pat. No. 4,895,547) and others teach yo-yos in which the tether-facing surface of each side member includes a plurality of raised ribs that project toward the tether. The ribs are arrayed in a starburst pattern about the center axis of the yo-yo. When the yo-yo is spinning at the end of the tether and the tether is momentarily made slack by the user, the portion of the tether proximate the yo-yo's axle will engage one or more of the ribs to thereby cause the tether to move with the side member and thereby wind about the axle. It should be noted that since the ribs protrude from the side members, they effectively define the sides of the string gap and make the string gap dependent on the shape of the ribs. As a result, the non-uniform tether-facing surfaces can make it more difficult for a user to perform yo-yo tricks without having the tether inadvertently engage said ribs. In addition, premature tether breakage may occur due to frequent rubbing contact between the ribs and the tether. Furthermore, since the prior art ribs are taught as being angled relative to the substantially planar tether-facing surface of their associated side member, the ribs cause the string gap to vary in width dependent on the distance from the axle. This may cause the yo-yo to respond differently as the degree of twist in the tether changes. This occurs since the tether's twist affects the location of the beginning point of the tether's end loop (the portion of the tether that permanently encircles the axle), a location that is often the initial point of engagement between the tether and one or the other of the side members.

Chua, in GB patent 2132100, teaches another structure for facilitating a yo-yo's return. A rubber ring is inset into the tether-facing surface of each of the yo-yo's side members. The ring extends a full 360 degrees about the axle and functions to snag the tether when the tether contacts the ring's surface.

SUMMARY OF THE INVENTION

The invention is an improved yo-yo in which the structure of the yo-yo in the area of the string gap is modified to enhance the yo-yo's performance while minimizing or negating many of the performance problems of the prior art. In the preferred embodiment of the invention, the yo-yo includes an axle that incorporates ball bearings for supporting an outer, rotatable cylindrical portion. The tether-facing surface of each side member is adapted to facilitate controlled engagement of the tether through the use of a plurality of grooves and/or high-friction engagement pads that are located about the center axis of each side member. When engagement between the tether and a groove and/or engagement pad occurs, the contacting portion of the tether is then forced to move with the associated side member. This causes the tether to wrap about the axle and the yo-yo to return to the user's hand.

The tether-facing surface of at least one of the yo-yo's side members features either a plurality of spaced-apart grooves, a plurality of spaced-apart engagement pads, or a combination of grooves and engagement pads. When the combination of grooves and pads is employed, each groove will be located between a pair of engagement pads.

When grooves are employed, each groove will have a width that is at least equal to one-half of the diameter of the tether. It should be noted that the width and depth of each groove may vary along the groove's length. The side edges of each groove are preferably relatively sharp to facilitate the snagging of the tether when said tether contacts any of the grooves. In the preferred embodiment, the grooves are located at 10–45 degree intervals about the center axis of each side member.

When engagement pads are employed, the pads are spaced from each other and preferably have a width at least equal to the diameter of the tether. In the preferred embodiment, the pads form a starburst pattern about the center axis of the associated side member. The pads may be located at 10–120 degree intervals about the associated side member's center axis. To achieve their engagement function, each of the pads is made of a high-friction material such as rubber. In the preferred embodiment, neoprene rubber of durometer 40 is used. The outer face of each pad is preferably substantially flush with the tether-facing surface of the associated side member.

In the preferred embodiment, all of the pads associated with a side member are attached at one end to a carrier ring that may be made of the same material as the pads. The carrier ring is located in a annular recess in the side member and has its outer surface flush with the tether-facing surface of the associated side member. The pads and carrier ring are preferably secured to the side member using adhesive located on the back face of the pads and/or carrier ring. When a groove is located between a pair of engagement pads, the sides of the pads form the sides of the groove. It should be noted that in this application, the term "groove" is a broad term and is defined as a cavity, channel or recess and may be formed from separate, discrete elements.

The employment of a tether engagement surface that does not protrude into the string gap (i.e.—does not extend toward the tether from the tether-facing surface of the side member), the invention eliminates the friction experienced by the prior art yo-yos that employed ribs that would often rub on the tether. As a result, both the potential spin time of the yo-yo and the expected life of the tether are increased. The combination of a plurality of spaced-apart grooves and/or engagement pads with an axle that incorporates ball bearings results in a yo-yo that can spin almost free from frictional slowing and is therefore capable of sleeping for a significant period of time.

The shape and non-protruding nature of the grooves and/or engagement pads also significantly reduce the chance of inadvertent snagging of the tether. Only when the user causes a momentary slackening of the tether will the resultant temporary expansion and/or sideways movement of the tether cause the tether to engage at least one of said grooves and/or engagement pads.

In addition, the non-protruding grooves and/or engagement pads allow the string gap to be uniform in width. As a result, the tether will normally only contact the engagement means (the grooves and/or engagement pads) when the tether is placed into a slackened condition. This is unlike the prior art yo-yos that featured short, angled ribs.

The use of grooves and/or engagement pads also enables the string gap area to be defined by the relatively perpendicular surfaces of the axle and the side member. Since these surfaces meet at substantially right-angled transition points, they provide an ideal geometry for enabling user control of the yo-yo.

The long grooves and/or engagement pads provide multiple extended areas for engagement with the tether and enable tether engagement even at locations that are significantly spaced from the yo-yo's axle. This extended area of engagement is virtually impossible in the prior art yo-yos that employ ribs to facilitate engagement since increased rib length tends to increase the chance of inadvertent snagging of the tether whenever the tether is not perfectly perpendicular to the yo-yo's center axis.

DETAILED DESCRIPTION OF THE DRAWINGS

Figure 1:
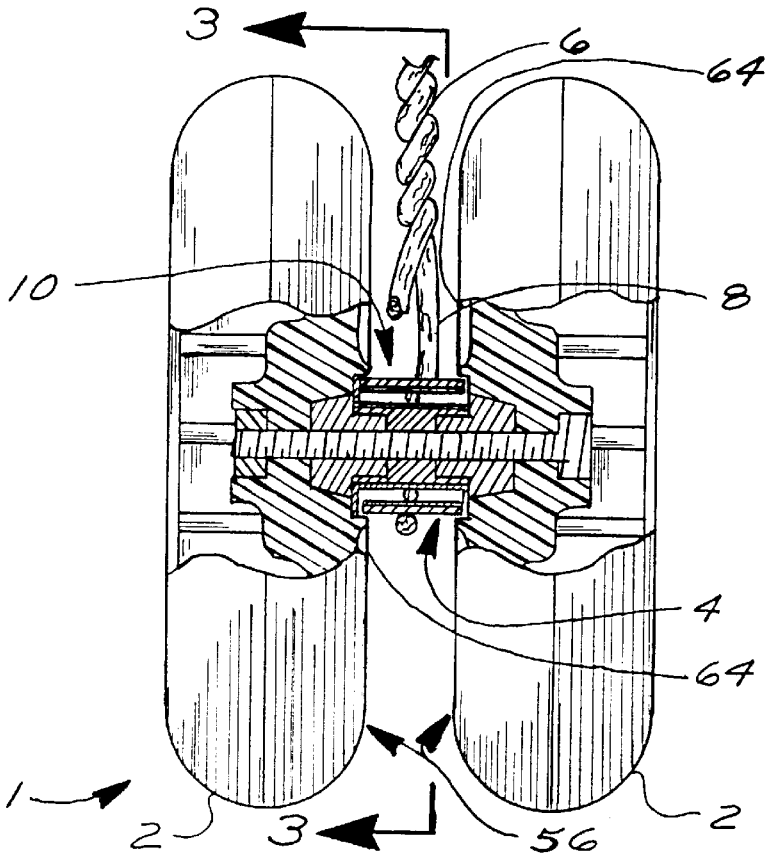
FIG. 1 is an elevational view, partially in cross-section, of a yo-yo in accordance with the invention.

Referring now to the drawings in greater detail, wherein like characters refer to like parts throughout the several figures, there is shown by the numeral 1 a yo-yo in accordance with the invention.

The yo-yo 1 includes first and second disk-shaped side members 2 that are connected together via an axle assembly 4. A string-type tether 6 includes a loop portion 8 that encircles a center portion 10 (tether-anchor) of the axle assembly. A distal portion (not shown) of the tether would normally be secured to one of a user's fingers.

As known in the art, each side member 2 includes an annular rim portion 12 (note FIG. 2), a hub 14 and a thru-bore 16 that extends through the side member, including the center of the hub. The side member also features a removable disk-shaped cap 18. Most of the side member's weight is concentrated in the rim portion to thereby provide the yo-yo with favorable balance and spin characteristics. The side members may be made of any well-known rigid or substantially rigid material such as wood, plastic or metal. In the preferred embodiment, each side member is made of a rigid plastic material.

Figure 2:
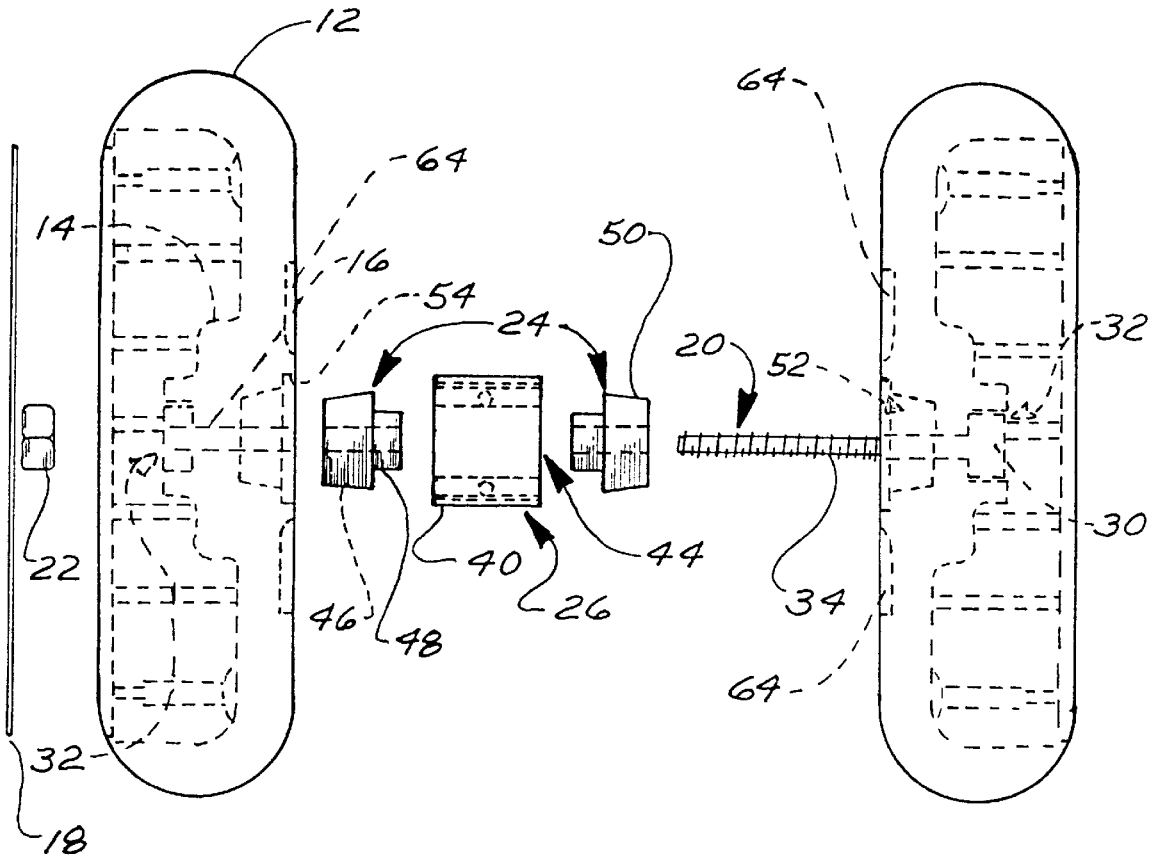
FIG. 2 is an exploded, elevational view of the yo-yo shown in FIG. 1.

FIG. 2 shows an exploded view of the yo-yo shown in FIG. 1. In this view, it can be seen that the axle assembly 4 includes an axle pin 20, a securement nut 22, two spacers 24 and a ball bearing unit 26. The axle pin is in the form of a hex head bolt in which the head 30 is non-rotatably secured within an open-ended hexagonally-shaped cavity 32 formed in the hub 14 of the right-hand side member 2. The left-hand side member 2 also includes an identical open-ended cavity 32 in which the hexagonally-shaped securement nut 22 is snugly and non-rotatably received. The nut 22 is normally threadedly engaged to a threaded portion 34 of the pin to thereby secure the two side members 2 together. If one desires to disassemble the yo-yo, the nut 22 can be unscrewed from the pin 20 by rotation of either of the yo-yo's side members 2 relative to the other.

Figure 3:
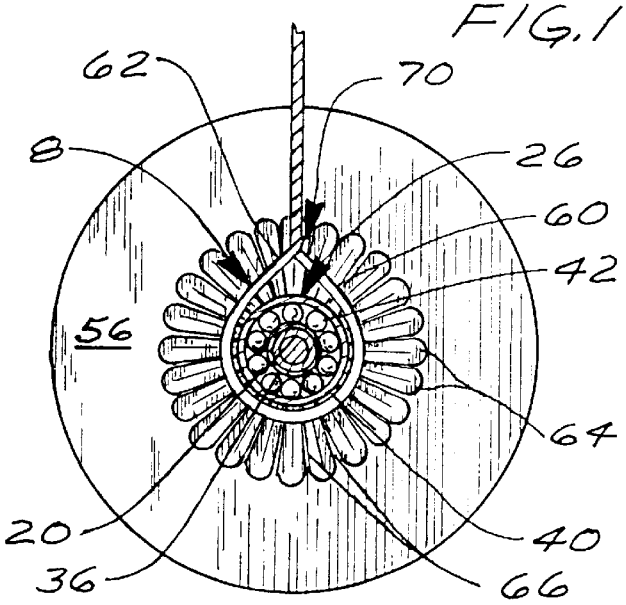
FIG. 3 is a sectional view of the yo-yo shown in FIG. 1 and taken at the plane labeled 3—3 in FIG. 1.

As can be seen in FIG. 3, the ball bearing unit 26 is conventional in design and basically includes an inner race 36, an outer race 40 and a plurality of ball bearings 42 located therebetween. It should be noted that other types of bearings, such as roller bearings, or other types of rotatable units, may be alternatively employed. The unit 26 is preferably of the type that cannot be disassembled. The inner race includes a thru-hole 44 through which the axle pin passes when the yo-yo is in an assembled condition.

Each spacer 24 includes a thru-hole 46 through which the axle pin will also pass. To secure the ball bearing assembly, each spacer 24 includes a reduced-diameter first end portion 48 that is removably received within the thru-hole 44 of the ball bearing unit. Once received, the shoulder at the inner end of portion 48 (note FIG. 1) will abut and contact the inner race 36 but will not contact the outer race 40. Each spacer includes a second end portion 50 adapted to be tightly, and immovably, received within a complementary cavity 52 in each side member 2.

When the yo-yo is assembled, portion 50 of each spacer is located completely within and contacts the associated side member. At the same time, a side edge of the outer race 40 is also received within a complementary recess 54 in the side member. It should be noted that the outer race does not contact either of the side members and therefore can move independently of said side members. The spacers bracket the bearing assembly as shown and position the outer race so that it is perpendicular to the plane of the tether-facing surface 56 of each side member without contacting said surface of either side member. It should also be noted that the inner race 36 of the ball bearing engages both of the spacers to thereby become locked to the side members and rotatable therewith.

FIG. 3 provides a detailed view of the tether's securement to the axle assembly as well as a view of the tether-facing surface 56 of one of the side members 2. It should be noted that the tether-facing surface of the other side member 2 is identical to the surface shown.

To manufacture the tether 6, one long string is folded on itself and the two halves of the string, 60 and 62, are twisted together. As a result, the tether has a diameter D which is actually twice the diameter of either of the string halves 60 or 62. To secure the tether to the yo-yo, the end of the tether where string halves 60 and 62 join together is untwisted to thereby form a loop 8 that is placed about the outer race 40 of the ball bearing unit.

When the yo-yo is sleeping at the end of the tether and the user causes the tether to become momentarily slack, the tether will no longer be constrained by the yo-yo's pull on the tether to stay located at the center of the string gap. In addition, as the tension in the tether is reduced, the diameter of the tether will also increase slightly, much in the same way as any rope will slightly increase in diameter as tension is removed. These factors allow a portion of the tether located in the string gap (the area between the side members 2, measured proximate the axle assembly) to engage the tether-facing surface 56 of one or both of the side members 2. To enhance the engagement so that the tether will begin to rotate with the spinning side members, the first embodiment of the invention employs a plurality of radially-oriented elongated grooves 64 that function to snag the tether as soon as the tether contacts surface 56. The area of the surface 56 that includes the grooves 64 is considered the tether engagement area.

Each of the grooves 64 has a longitudinal axis that is parallel to the tether-facing surface 56 of the associated side member and perpendicular to the center axis of the yo-yo as defined by the longitudinal axis of the axle pin 20. The grooves are similar in shape to a teardrop (other elongated shapes may be employed) and each features two long sides 66 that form a sharp, right-angled edge where they intersect with the substantially planar surface 56 of the side member. Preferably, each groove has maximum width and depth dimensions that are at least equal to ½D (½ the tether diameter). The width and depth dimensions may vary with the distance away from the yo-yo's center axis.

As can be seen in FIG. 3, the two strands 60 and 62 that form the tether separate from each other at a point labeled 70 to form the tether's loop 8. As noted previously, the point at which the strands unite can vary in distance from the axle dependent on the amount of twist in the tether. Since point 70 will sometimes define the initial contact point between the tether and a side member, the length of the grooves must be such that they can engage point 70 even when said point is closely spaced to or distantly spaced from the axle assembly.

In the preferred embodiment, each side member 2 has a diameter of approximately 2.2 inches, the ball bearing unit (which can also be considered the yo-yo's axle means) has an outer diameter of approximately 0.4 inches, the string gap is approximately 1.5–2.0 times the tether diameter, and each groove has a length of approximately ⅓ of an inch. To be effective, the grooves should have a minimum length of approximately ½ of the diameter of the axle means. The grooves can have a maximum length of almost one-half of the diameter of the side member. In yo-yos that have a different ratio of side member diameter to axle means diameter, the grooves should have a minimum length that will enable contact with point 70 of the tether no matter the degree of twist in said tether.

In an alternate embodiment that is not shown, the grooves are located in a separate disk-shaped member. Said member is non-rotatably secured within a complementary recess in the tether-facing surface of an associated side member.

Figure 4:
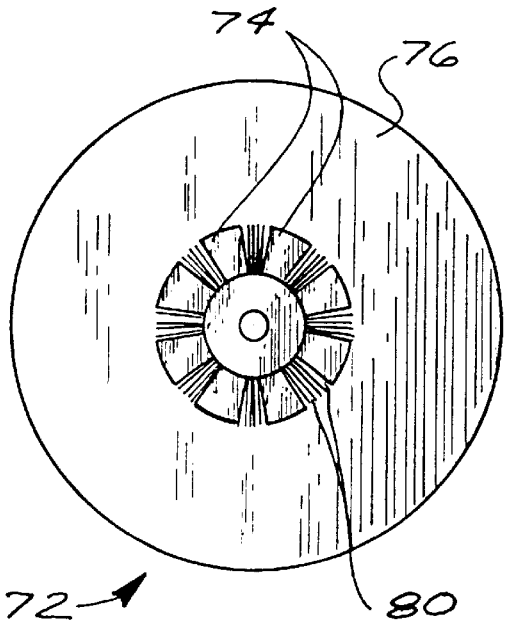
FIG. 4 is an elevational view of the tether-facing surface of a side member of a yo-yo of the type shown in FIG. 1. This view shows an alternate form of tether engagement area.

FIG. 4 shows an alternate embodiment of the tether engagement area of a side member 72. Side member 72 is identical to side member 2 except for differences in the tether engagement area. In this embodiment, there are a plurality of large, radially-oriented, elongated grooves 74. In the area between the grooves, the tether-facing surface 76 of the side member includes a plurality of much smaller radially-oriented grooves 80. The smaller grooves can be used to provide an engagement area with the tether or to help guide the tether into the larger grooves when the tether is placed in a slackened condition.

Figure 5:
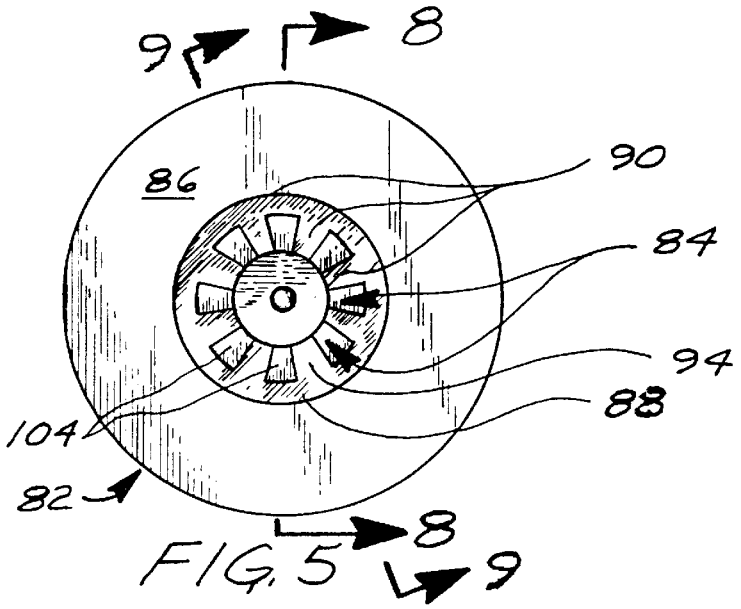
FIG. 5 is an elevational view of the tether-facing surface of a side member of a yo-yo of the type shown in FIG. 1. This view shows another alternate form of tether engagement area.
Figure 10:
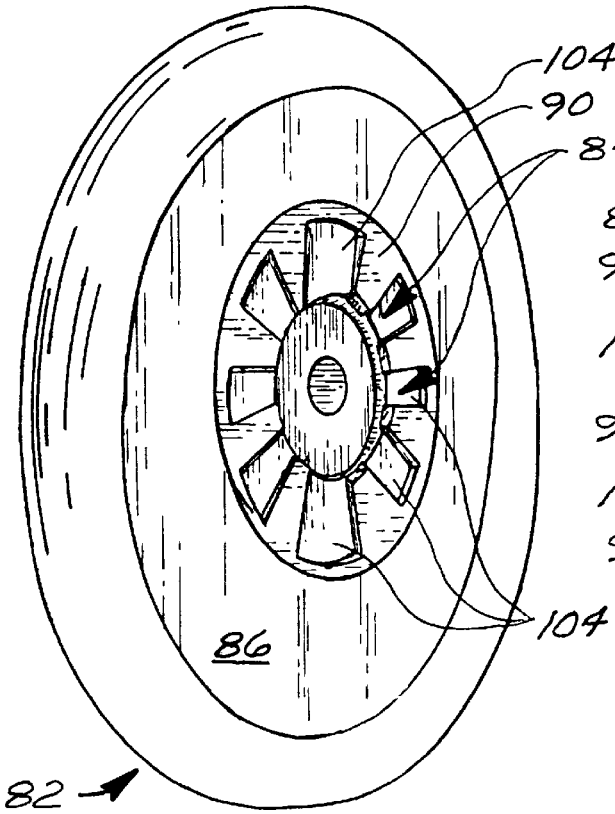
FIG. 10 is a perspective view of the side member shown in FIG. 5.

FIG. 5 provides an elevational view of another embodiment of a side member 82. A perspective view of side member 82 is provided in FIG. 10. Side member 82 is identical to side member 2 except for differences in the tether engagement area and as such, can replace each of the side members 2 shown in FIGS. 1 and 2. In this embodiment, there are a plurality of radially-oriented, elongated recesses/grooves 84 in the tether-facing surface 86. The length and orientation of the grooves 84 are substantially identical to grooves 64 of the first embodiment. As can also be seen in the figures, a ring-shaped carrier member 88 encircles the grooves 84. A plurality of engagement pads 90 extend inwardly from the carrier member and are located in an alternating relation with the grooves 84. The sides of adjacent pads form the sidewalls of each groove 84.

Each pad 90 is shown as having a substantially elongated, trapezoidal shape. The pads are preferably made of a material that has a higher coefficient of friction than the surrounding material of the side member. In the preferred embodiment, the pads are made of a rubber material, such as neoprene rubber. It should be noted that while pads 90 are preferably made of a rubber material, they can alternatively be made from other materials that feature an outer surface that has a high frictional coefficient. An example of such an alternate material is sandpaper.

The pads 90 are received within complementary grooves 92 in the associated side member. The tether-facing surface 94 of each pad is preferably co-planar with the tether-facing surface 86 of the side member. In the preferred embodiment, the pads 90 are spaced at 45 degree intervals about the yo-yo's center axis. The pads may alternatively be spaced at 10–120 degree intervals about the yo-yo's center axis. The length of each pad is preferably equal to or greater than one-half of the diameter of the axle assembly 4 and is preferably also equal to the length of the grooves 84.

The carrier member 88 functions to facilitate insertion and manufacture of the plurality of pads 90. As can be seen in the figures, each pad 90 is attached at one end to the carrier member. The carrier member is received within an annular recess 98 in the member 82. The recess 98 is preferably located in an area of the tether-facing surface that is exterior to the pads 90 and grooves 84. It should be noted that the carrier member is optional and the pads 90 can instead be separate pieces that are individually secured within their respective grooves 92.

Figure 7:
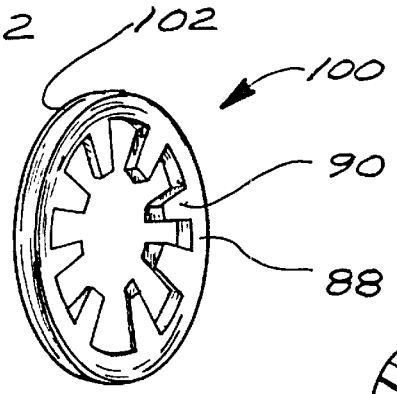
FIG. 7 is a perspective view of the engagement pads and their carrier member.

In the preferred embodiment, the carrier member 88 and pads 90 together form a pad unit 100. The pad unit is shown in FIG. 7 and may be manufactured using a die-cut process from a single sheet of rubber material of uniform thickness. Once formed, the unit can be placed into the member 82 as a single piece. To secure unit 100 to the side member 82, the rear surface of the pads and/or carrier member are coated with an adhesive material 102 that functions to permanently secure the unit 100 to the member 82. The adhesive material may be applied to the rear surface of the unit at an early stage of manufacture and temporarily covered with a removable backing sheet (not shown).

Figure 6:
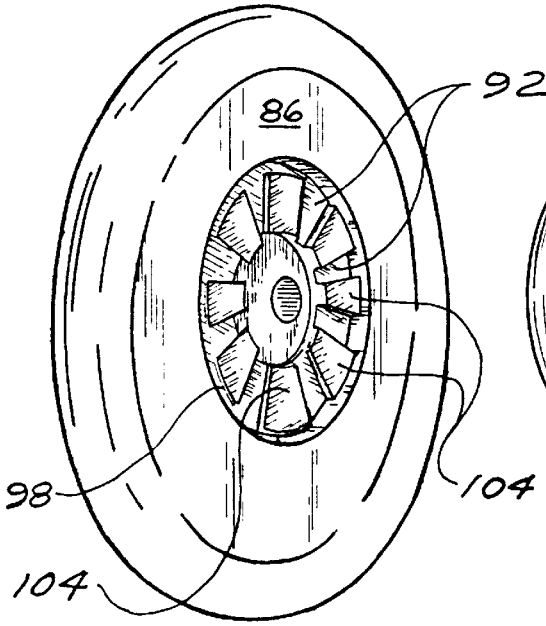
FIG. 6 is a perspective view of the side member shown in FIG. 5 less the engagement pads and their carrier member.

FIG. 6 shows a detailed perspective view of the member 82 prior to the insertion of the pad unit 100. The surfaces indicated by 104 will each become the bottom of a groove 84. The grooves 92 are designed to receive the pads 90 of the pad unit 100. The annular recess 98 for the receipt of the carrier member 88 can also be seen.

Figure 8:
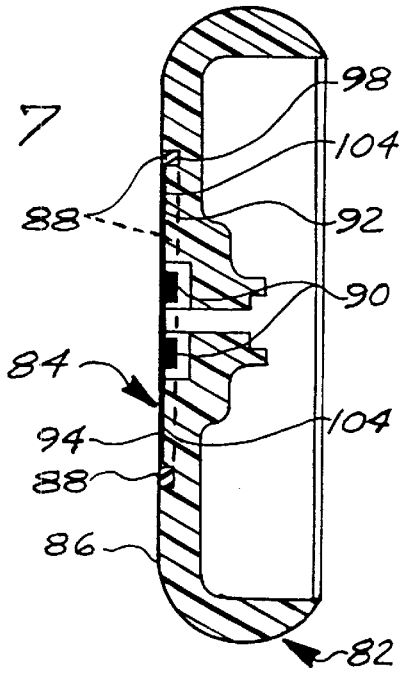
FIG. 8 is a cross-sectional view of the side member shown in FIG. 5 and taken at the plane indicated by 8—8 in FIG. 5.
Figure 9:
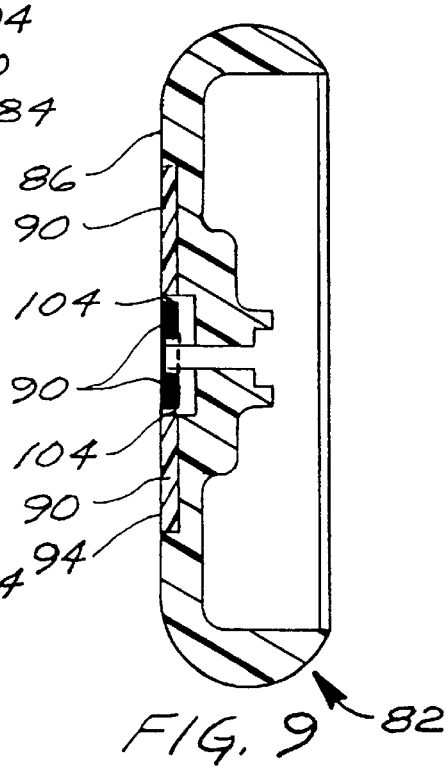
FIG. 9 is a cross-sectional view of the side member shown in FIG. 5 and taken at the plane indicated by 9—9 in FIG. 5.

FIGS. 8 and 9 provide cross-sectional views of the side member 82. In these views, one can see that the tether-facing surface of each pad member 90 is co-planar with the tether-facing surface 86 of the side member. One can also see that the bottom surface 104 of groove 84 is located below the plane of the member's tether-facing surface 86. In the preferred embodiment, surface 104 is approximately 0.030 inches below surface 86.

Figure 11:
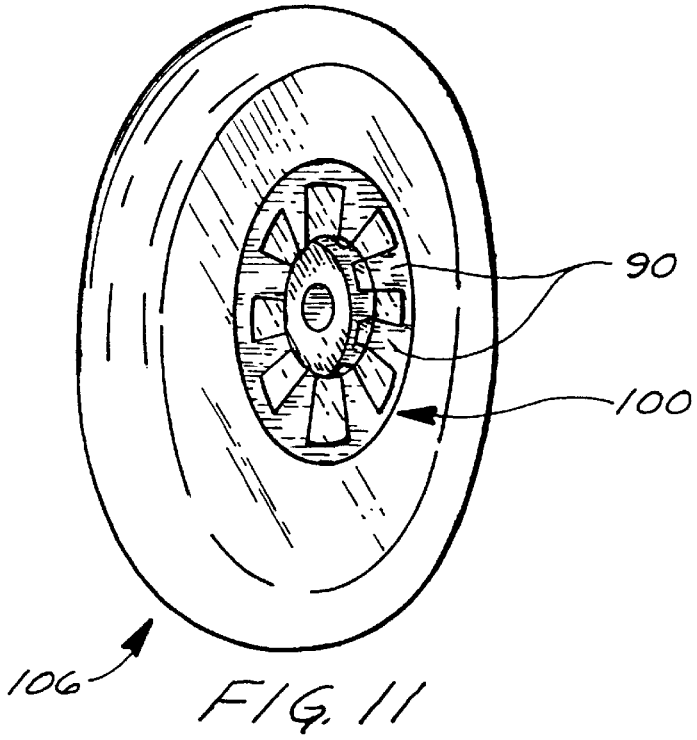
FIG. 11 is a perspective view of another alternate embodiment of a side member for a yo-yo of the type shown in FIG. 1.

FIG. 11 provides a perspective view of another alternate embodiment of a side member for a yo-yo of the type shown in FIG. 1. In this embodiment, the side member 106 features the same pad unit 100 as described in the previous embodiment. However, there are no grooves located between each pad 90. The pads 90 are located in complementary grooves 92 that are identical to the grooves 92 shown in FIG. 6.

While the use of grooves 84 between pads 90 is optional, the grooves provide an interruption in the plane of the tether-facing surface of the side member. It is believed that the resultant non-uniform surface creates a non-laminar boundary layer of air that facilitates the tether's movement toward the side member and thus the tether's contact with the rubber pads.

It should be noted that the use of radially-oriented tether engagement grooves and/or engagement pads, as taught herein, can be employed with other types of yo-yos. For example, the grooves and/or pads can facilitate tether engagement in conventional yo-yos that make use of a fixed axle (i.e.—an axle that is fixed to the side members and does not incorporate a ball bearing supported portion).

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side members;

a tether anchor located between said side members;

a securement means for securing together said side members;

a tether secured to said tether anchor and adapted for winding thereon; and wherein each of said side members has a tether-facing surface that faces a portion of said tether located adjacent said tether anchor, wherein said surface of at least one of said side members features a plurality of engagement pads located in a spaced-apart relation about the tether anchor, wherein said engagement pads are located in complementary grooves in the associated side member, wherein each engagement pad has an exterior surface that has a coefficient of friction greater than a coefficient of friction of a surrounding area of said tether-facing surface and wherein said pads function to facilitate engagement between the tether and at least one of said side members.

2. The yo-yo of claim 1 wherein both of said side members feature a plurality of engagement pads located in a spaced relationship from each other and about the yo-yo's tether anchor.

3. The yo-yo of claim 1 wherein a plurality of said engagement pads have an elongated shape and extend radially away from said tether anchor.

4. The yo-yo of claim 1 wherein each of said engagement pads is made from a rubber material.

5. The yo-yo of claim 1 wherein the tether anchor includes an inner race, an outer race and a plurality of bearing members located between said races and wherein said tether includes a loop portion that encircles said outer race.

6. The yo-yo of claim 1 wherein said engagement pads are substantially flush with the tether-facing surface of their associated side member.

7. The yo-yo of claim 1 wherein the tether anchor has an outer diameter and wherein each of a plurality of said engagement pads has a length at least equal to one-half of said outer diameter of said tether anchor.

8. The yo-yo of claim 1 wherein each of said side members has an outer diameter and wherein each of a plurality of said engagement pads has a length no greater than one-half of the outer diameter of the associated side member.

9. The yo-yo of claim 1 wherein the tether-facing surface of each of said side members in the area proximate the tether anchor is substantially perpendicular to an outer surface of the tether anchor.

10. The yo-yo of claim 1 wherein each side member is made of a plastic material.

11. The yo-yo of claim 1 wherein there is a recess located between a pair of said engagement pads.

12. The yo-yo of claim 1 wherein a recess is located between each of said engagement pads.

13. The yo-yo of claim 1 wherein the engagement pads are spaced at between 15 and 120 degree intervals about said center axis.

14. The yo-yo of claim 1 wherein each engagement pad has a trapezoidal shape.

15. The yo-yo of claim 1 wherein the engagement pads associated with one of said side members are all attached to a common carrier member.

16. The yo-yo of claim 15 wherein the carrier member is ring-shaped.

17. The yo-yo of claim 15 wherein the engagement pads are made of a rubber material and the carrier member is made of the same rubber material and wherein the engagement pads form inwardly extending portions of the carrier member.

18. A yo-yo comprising:

first and second side members;

a tether anchor located between said side members;

a securement means for securing together said side members;

a tether secured to said tether anchor and adapted to be wound thereon; and wherein each of said side members has a tether-facing surface that faces a portion of said tether located adjacent said tether anchor, wherein said surface of at least one of said side members features a plurality of engagement pads and recesses, wherein said engagement pads are located in complementary grooves in the associated side member and have a coefficient of friction at least equal to that of rubber, and wherein said engagement pads and recesses are located in alternating relation about the center of the associated side member and function to facilitate engagement between said tether and at least one of said side members.

19. The yo-yo of claim 18 wherein the recesses are arrayed in a starburst pattern about a center point of the associated side member.

20. A yo-yo comprising:

first and second side members;

a tether anchor located between said side members;

a securement means for securing together said side members;

a tether secured to said tether anchor and adapted for winding thereon; and wherein each of said side members has a tether-facing surface that faces a portion of said tether located adjacent said tether anchor, wherein said surface of at least one of said side members features a plurality of engagement pads located in a spaced-apart relation about the tether anchor, wherein each engagement pad has an exterior surface that has a coefficient of friction greater than a coefficient of friction of a surrounding area of said tether-facing surface, wherein said pads are made from a rubber material and wherein said pads function to facilitate engagement between the tether and at least one of said side members.

21. The yo-yo of claim 20 wherein a recess is located between adjacent engagement pads.

22. A yo-yo comprising:

first and second side members;

a tether anchor located between said side members;

a securement means for securing together said side members;

a tether secured to said tether anchor and adapted for winding thereon; and wherein each of said side members has a tether-facing surface, wherein a portion of said tether-facing surface is located adjacent said tether anchor and is planar, wherein a plurality of engagement pads are inset into said surface and do not protrude outwardly from said surface toward said tether, wherein said pads are located in a spaced-apart relation about the tether anchor, wherein each engagement pad has an exterior surface that has a coefficient of friction greater than a coefficient of friction of a surrounding area of said tether-facing surface and wherein said pads function to facilitate engagement between the tether and at least one of said side members.

23. The yo-yo of claim 22 wherein a recess is located between adjacent engagement pads.

24. A yo-yo comprising:

first and second side members;

a tether anchor located between said side members;

a securement means for securing together said side members;

a tether secured to said tether anchor and adapted for winding thereon; and wherein each of said side members has a tether-facing surface that faces a portion of said tether located adjacent said tether anchor, wherein said surface of at least one of said side members is made of a first material and features a plurality of engagement pads located in a spaced-apart relation about the tether anchor, wherein each engagement pad has an exterior surface that is made of a material that is different from said first material and has a coefficient of friction greater than a coefficient of friction of said first material, and wherein said pads function to facilitate engagement between the tether and at least one of said side members.

25. The yo-yo of claim 24 wherein a recess is located between adjacent engagement pads.

* * * * *